US005340952A

United States Patent [19]

Takiguchi

[11] Patent Number: 5,340,952

[45] Date of Patent: Aug. 23, 1994

[54] EXHAUST MUFFLER COMBINING COMPONENTS MADE OF DIFFERENT MATERIALS

[75] Inventor: Shiro Takiguchi, Wako, Japan

[73] Assignee: Honda Giken Kogyo Kabushiki Kaishi, Tokyo, Japan

[21] Appl. No.: 960,635

[22] Filed: Oct. 14, 1992

[30] Foreign Application Priority Data

Oct. 30, 1991 [JP] Japan ..... 3-097237[U]
Oct. 30, 1991 [JP] Japan ..... 3-311605

[51] Int. Cl.[5] ..... F01N 7/18

[52] U.S. Cl. ..... 181/282; 181/249; 181/252; 181/256

[58] Field of Search ..... 181/241, 243, 245, 246, 181/248, 249, 250, 252, 255, 256, 271, 282

[56] References Cited

U.S. PATENT DOCUMENTS 2,834,427 5/1958 Powers et al. ..... 181/243
3,227,242 1/1966 Mattoon ..... 181/252
4,213,414 7/1980 Sato et al. ..... 181/282 X
4,239,091 12/1980 Negrao ..... 181/243
4,513,841 4/1985 Shimoji et al. ..... 181/252
4,589,516 5/1986 Inoue et al. ..... 181/282 X
4,598,790 7/1986 Ueguchi et al. ..... 181/252
4,993,513 2/1991 Inoue et al. ..... 181/282

*Primary Examiner*—Michael L. Gellner
*Assistant Examiner*—Khanh Dang
*Attorney, Agent, or Firm*—Armstrong, Westerman, Hattori, McLeland & Naughton

[57] ABSTRACT

An exhaust muffler for an internal combustion engine including an outer shell containing two halves made of synthetic resin material, a metallic inner pipe extending through the parting plane between the two halves via a tubular extension extending integrally from the two halves, and an outer sleeve which is fitted onto the tubular extension, preferably by using a bayonet mount structure, for securely joining the two halves at its one end and forming an air-tight seal in cooperation with the part of the inner pipe extending out of the tubular extension at its other end. An arrangement is provided for accommodating a relative displacement between the other end of the outer sleeve and the inner pipe for avoiding the generation of thermal stress due to the difference in the coefficient of thermal expansion between the outer shell and the inner pipe made of different materials.

11 Claims, 6 Drawing Sheets

EXHAUST MUFFLER COMBINING COMPONENTS MADE OF DIFFERENT MATERIALS

TECHNICAL FIELD

The present invention relates to an exhaust muffler for an internal combustion engine, and in particular to an exhaust muffler comprising an outer shell made of synthetic resin, and a metallic inner pipe passed through the outer shell.

BACKGROUND OF THE INVENTION

It has been proposed to form the outer shell of an exhaust muffler for an internal combustion engine with synthetic resin material having favorable anti-corrosive and sound-insulating properties while the inner pipe which is required to be heat-resistant is made from metallic material. As a mode of combining these two components made of different materials, it would be convenient to form the outer shell from two halves, and interpose the inner tube between two halves of the outer shell.

However, according to such a structure, the materials of the inner pipe and the outer shell are so different in material properties, such as the coefficient of thermal expansion, the coefficient of heat transfer, and elastic modulus, that the parts joining these two components tend to be subjected to significant thermal stress because the inner pipe is directly exposed to the heat of the exhaust gas and has a greater coefficient of thermal expansion than the outer shell. In particular, when these two components are rigidly joined together by using such an adhesive agent as thermo-setting resin, the outer shell which is lower than the inner pipe in mechanical strength may develop cracks, or the adhesive agent may be detached from the outer shell after repeated thermal stress. Further, the heat from the inner pipe will adversely affect the parts joining the two halves of the outer shell together.

Japanese utility model laid open publication No. 02-85819 discloses a substantially cylindrical outer shell for an exhaust muffler combining a heat resistant metallic or ceramic tube and an anti-corrosive and sound-insulating synthetic resin sleeve member. The end plates of the outer shell are each provided with a deformable portion for accommodating both radial and axial relative displacement between the outer shell and the inner pipe. However, this structure requires a large number of component parts, and requires time-consuming steps which are not suited for automotization for its assembly. Therefore, this conventional exhaust muffler would be unacceptably expensive to manufacture.

BRIEF SUMMARY OF THE INVENTION

In view of such problems of the prior art, a primary object of the present invention is to provide an exhaust muffler combining an outer shell made of synthetic resin with an inner pipe made of metal which is easy to assemble and durable in use.

A second object of the present invention is to provide an exhaust muffler which is capable of effectively controlling exhaust noises.

A third object of the present invention is to provide an exhaust muffler which is economical to fabricate.

According to the present invention, these and other objects of the present invention can be accomplished by providing an exhaust muffler, comprising: an outer shell consisting of two halves made of synthetic resin material abutting each other at a brim portion of each of the two halves, each of the two halves being provided with a hollow semi-cylindrical extension extending from the brim portion of the corresponding half so as to form a completely tubular extension by the cooperation of the two hollow semi-cylindrical extensions; an inner pipe made of metallic material extending through the outer shell and out of the tubular extension of the outer shell; a sleeve member fitted onto the tubular extension at one end thereof and fitted in a substantially airtight fashion onto a part of the inner pipe extending out of the tubular extension of the outer casing at the other end thereof; and fastening means for securing the sleeve member fitted on the tubular extension and producing a radial securing force which urges the semi-cylindrical extensions toward each other.

Thus, the sleeve member provides favorable means for joining the two halves of the outer shell in cooperation with the tubular extension, for instance by using a wedge effect. For instance, a side surface of the annular radial projection facing away from the outer shell may be formed as a tapered annular surface so that a radially joining force may be produced between the two halves as the sleeve member is fitted and fastened on the tubular extension. Thus, the durability of the exhaust muffler can be improved with the added advantage of simplifying the assembling process.

Preferably, the one end of the sleeve member may be connected to the tubular extension by way of a bayonet coupling structure, wherein the tubular projection of the outer shell is provided with an annular radial projection having at least one notch, and the one end of the sleeve member is provided with a radially inwardly directed projection which is adapted to be axially passed through the notch when the sleeve member is fitted onto the tubular extension so that the sleeve member may be secured on the tubular extension by turning the sleeve member around an axial line thereof after the sleeve member is fitted onto the tubular extension until the radially inwardly directed projection is passed through the notch beyond the annular radial projection.

According to a preferred embodiment of the present invention, the sleeve member is made of metallic material, and the outer shell is internally lined with a layer of insulating material, and an extension of the insulating material layer extends into an annular space between the sleeve member and the inner pipe.

In particular, to accommodate relative displacement between the outer shell and the inner pipe, it is preferable to provide means for accommodating such relative displacement in view of avoiding application of undesirable thermal stress to the outer shell which may have a relatively low mechanical strength.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
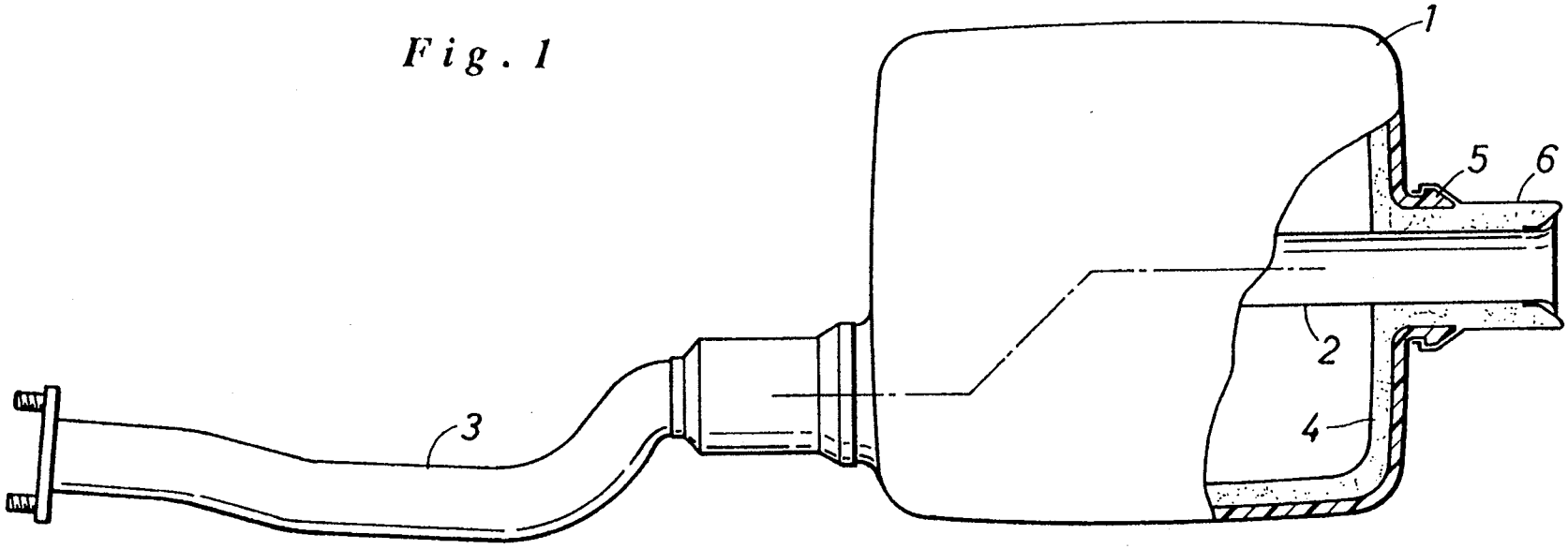
FIG. 1 is a plan view of an embodiment of the exhaust muffler according to the present invention.

FIG. 1 is an overall view of an exhaust muffler according to the present invention. This exhaust muffler comprises an outer shell 1 defining an expansion chamber therein, and an inner pipe 2 passed through the outer shell 1. One end of the inner pipe 2 is connected to an internal combustion engine not shown in the drawings via a front pipe 3.

The outer shell 1 consists of two halves made of synthetic resin material, and combined into a hollow member, and is lined with a layer of insulating material 4 such as glass wool on its inner surface. A hollow semi-cylindrical extension extends outwardly from each of a pair of diagonally opposed positions of the rim of each of the two halves of the outer shell 1. When the two halves are combined, the semi-cylindrical extensions form a complete hollow tubular extension 5, and an end of the inner pipe 2 is passed through each of the tubular projections 5. In FIG. 1, one of the tubular extensions 5 is shown in section while the other tubular extension connected to the front pipe 3 is shown as an external view. Since these two tubular extensions have a more or less similar structure, the following discussion will be limited to the tubular extension 5 illustrated on the right hand side of FIG. 1.

Figure 5:
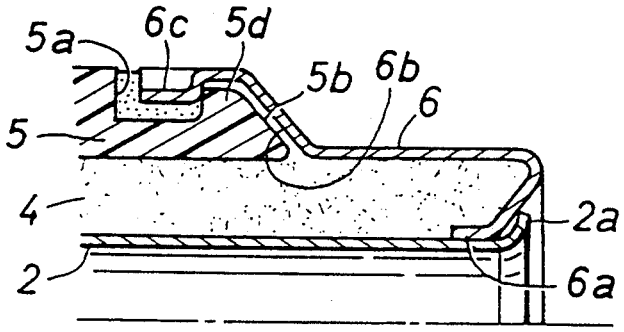
FIG. 5 is a sectional view of the sleeve member and the structure related thereto.

Referring to FIG. 5, the free end 2*a* of the inner pipe 2 projecting from the tubular extension 5 is expanded or flared in the form of a funnel. The extension 5 and the part of the inner pipe 2 extending out of the extension 5 is covered by a sleeve member 6 made of metallic material. One end of the sleeve member 6 is engaged to the free end of the extension 5, and the other end of the sleeve member 6 is closely fitted upon the outer circumference of the free end of the inner pipe 2.

As best illustrated in FIG. 5, the end of the sleeve member remote from the extension 5 is folded back inwardly as denoted by numeral 6*a* so that the folded portion 6*a* may elastically engage with the outer surface of the inner pipe 2. This is preferable to the end of preventing the generation of noises and the leakage of exhaust gas from the expansion chamber. The inner diameter of the folded portion 6*a* is smaller than the flared end of the inner pipe 2 so that the outward movement of the sleeve member 6 may be prevented. The flared portion is required to be formed after the outer shell 1 is combined with the inner pipe 2 and the sleeve member 6 is fitted onto the tubular extension 5.

The annular space defined between the inner pipe 2, and the extension 5 and the sleeve member 6 is filled with insulating material such as glass wool which may be a part of the insulating layer 4 lining the expansion chamber.

The extension 5 is provided with a tapered outer surface 5*b* at its free end, and an annular groove 5*a* adjacent the tapered outer surface 5*b* as shown in FIG. 5, thus defining an annular radial projection 5*d* therebetween. The corresponding end of the sleeve member 6 is provided with a tapered inner surface 6*b* corresponding to the tapered outer surface 5*b*, and four equally spaced projections 6*c* directed radially inwardly. The annular radial projection 5*d* of the extension 5 is provided with four notches 5*c* corresponding to the radial projections 6*c*.

Figure 2:
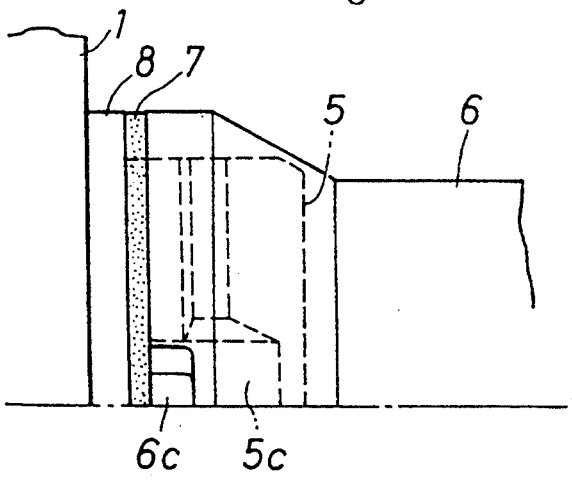
FIG. 2 is an enlarged view showing a part of FIG. 1.
Figure 3:
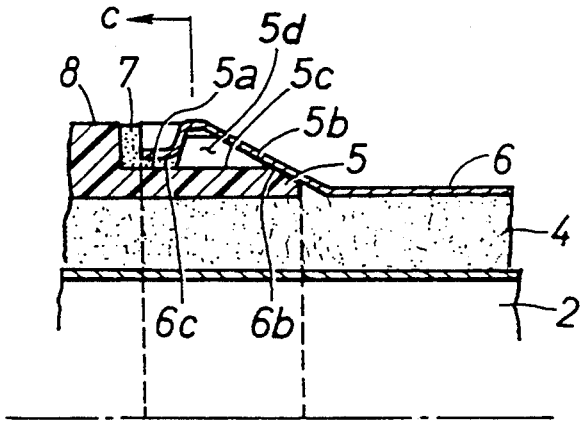
FIG. 3 is a sectional view of a part of the exhaust muffler shown in FIG. 2.
Figure 4:
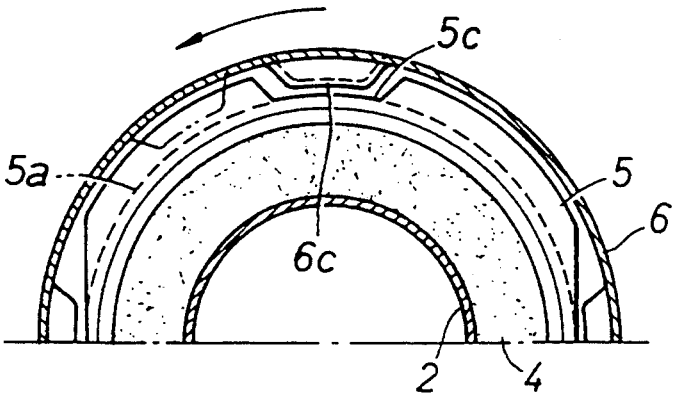
FIG. 4 is a sectional view taken along line IV of FIG. 3.

Thus, referring to FIGS. 2 through 4, when assembling this exhaust muffler, first of all, the two halves of the outer shell 1 are joined with each other with the inner pipe 2 received in the tubular projections 5 and the expansion chamber, and the sleeve member 6 is axially fitted onto each of the extensions 5 by allowing the radial projections 6*c* to pass through the notches 5*c* until the radial projections 6*c* are received in the annular groove 5*a* of the extension 5. Then, the sleeve member 6 is turned around its axial line, and the radial projections 6*c* are pushed against the corresponding side surface of the annular groove 5*a*. The dimensions of the annular radial projection 5*c* and the groove 5*a* are so determined that the annular radial projection 5*d* is securely forced into the space between the tapered inner surface 6*b* and the radial projections 6*c*. Preferably, each corner between the notch 5*c* and the associated side surface may be appropriately rounded or sloped so that a wedge effect may be produced when the sleeve member 6 is turned around its axial line after the radial projections 6*c* are received in the groove 5*a*.

As a result, both axial and radial engagement forces are produced between the tapered inner surface 6*b* and the tapered outer surface 5*b*, and the sleeve member 6 and the extension 5 are securely joined together. A bonding agent 7 may be filled into the gap defined between the sleeve member 6 and the extension 5, and a flange 8 provided at the base end of the extension 5 aids the containment of the bonding agent 7 in the annular groove 5*a*.

Figure 7:
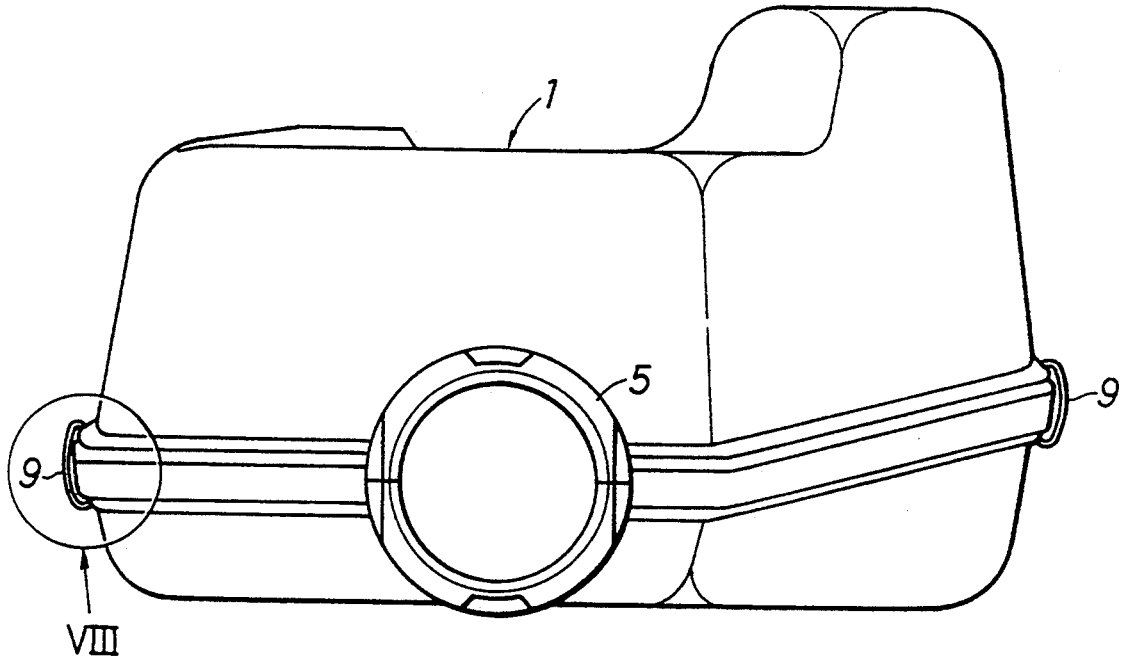
FIG. 7 is an end view of the exhaust muffler.
Figure 8:
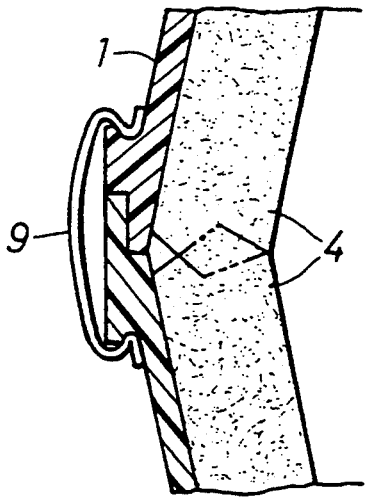
FIG. 8 is an enlarged sectional view of a part of FIG. 7 indicated by circle VIII.

The outer shell 1 consists of two halves divided by a plane containing the central line of the inner pipe 2 as illustrated in FIG. 7. The brims of the two halves mate with each other in a complementary fashion, and are joined together with a bonding agent and elastic clips 9 which urge the two halves toward each other as best illustrated in FIG. 8. Thus, combined with the clamping force of the sleeve member 6, the two halves of the outer shell 1 are securely attached to each other.

The insulating layer 4 of each of the two halves of the outer shell is provided with a convex side edge so that, when joining the two halves of the outer shell 1, the mutually abutting edges of the insulating layers 4 may be closely joined together without a part of it being caught between the mating brims of the two halves of the outer shell 1 or leaving any gap therebetween.

Figure 6:
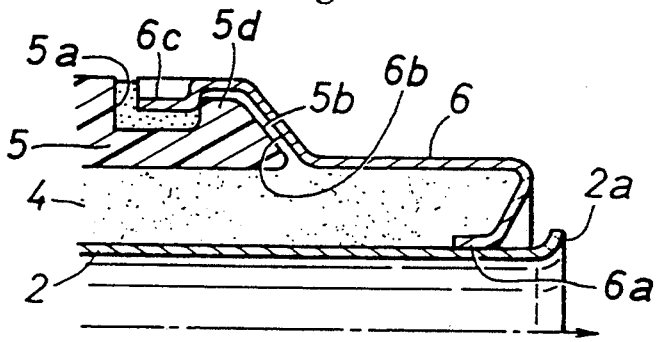
FIG. 6 is a view similar to FIG. 5 showing the state in which the inner pipe is thermally expanded.

According to the present invention, since the metallic material, for instance steel, which makes up the inner pipe 2 has a greater coefficient of thermal expansion than the outer shell, it is necessary to accommodate a relative displacement therebetween. In this embodiment, relatively sliding movement is allowed between the rear end of the sleeve member 6 and the inner pipe 2 without breaking a substantially air-tight engagement therebetween as illustrated in FIGS. 5 and 6.

Figure 9:
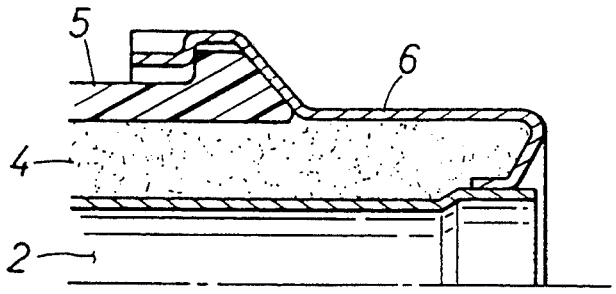
FIGS. 9 through 13 are views similar to FIG. 5 showing different embodiments of the present invention.

In the embodiment illustrated in FIG. 9, the rear end of the inner pipe 2 is formed as a part having a cylindrical shape and a slightly enlarged diameter. The rear end of the sleeve member 6 is engaged to this part having the enlarged diameter. In this case, it is not necessary to flare the rear end of the inner pipe 2 after assembling the exhaust muffler.

Figure 10:
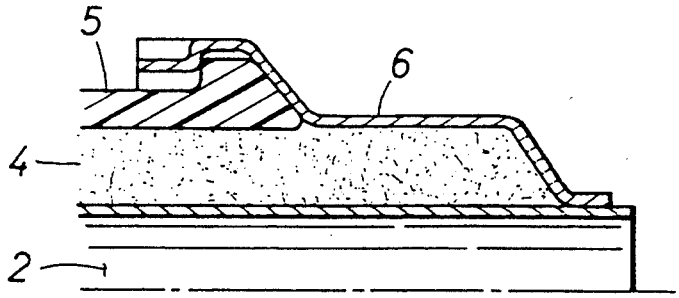

In the embodiment illustrated in FIG. 10, the entire length of the inner pipe 2 extending out of the outer shell 2 is provided with a constant diameter, and the rear end of the sleeve member 6 is simply constricted so as to be closely fitted onto the rear end of the inner pipe 2.

Figure 11:
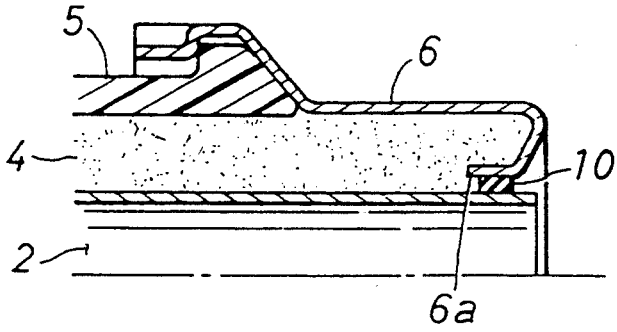

In the embodiment illustrated in FIG. 11, the rear end of the sleeve member 6 is folded back inwardly in a fashion similar to the first embodiment, but an annular member 10 having a heat resistance and a low coefficient of friction is interposed between the folded back portion 6*a* of the sleeve member 6 and the rear end of the inner pipe 2 so that they may slide one over the other without excessive friction and transmission of heat from the inner pipe 2 to the outer shell 1 via the sleeve member 6 may be minimized.

Figure 12:
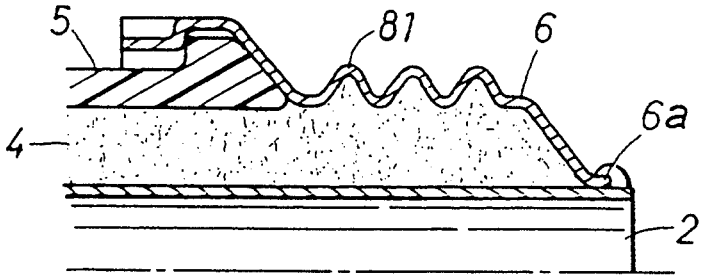

In the embodiment illustrated in FIG. 12, the rear end 6*a* of the sleeve member 6 is securely welded to the rear end of the inner pipe 2, and the middle part of the sleeve member 6 is corrugated along its circumference as denoted by numeral 81 so as to accommodate the relative movement between the outer shell 1 and the inner pipe 2 without breaking the air-tight seal therebetween.

Figure 13:
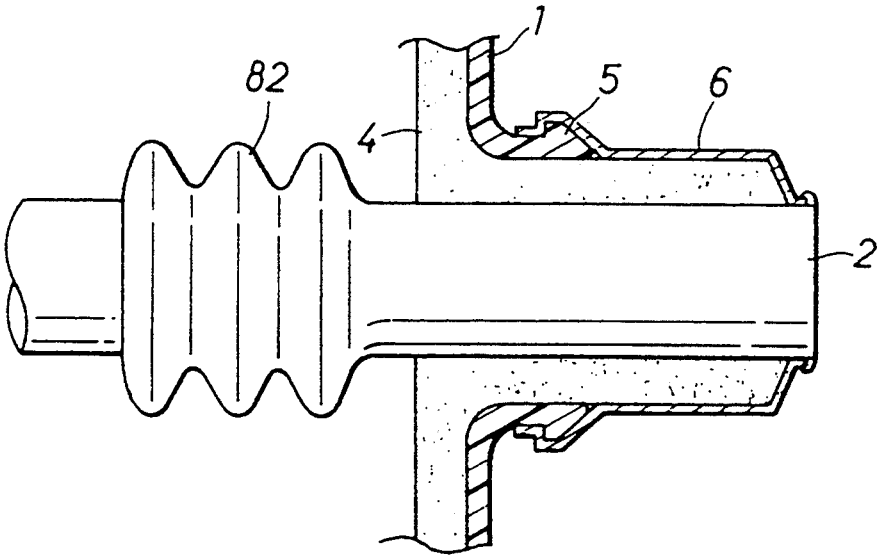

In the embodiment illustrated in FIG. 13, the rear end of the sleeve member 6 is securely welded to the rear end of the inner pipe 2 in the same manner as in the previously described embodiment, but a part of the inner pipe 2, instead of the middle part of the sleeve member 6, is corrugated along its circumference as denoted by numeral 82 so as to accommodate the relative movement between the outer shell 1 and the inner pipe 2 without breaking the air-tight seal therebetween.

According to the present invention, since the bayonet type joining structure between the sleeve member and the tubular extension of the outer shell tends to join the two halves close to each other, the integrity of the outer shell can be ensured without depending on any bonding agent. Further, since the inner pipe is retained in the outer shell by way of the sleeve member, direct contact between the outer shell and the inner pipe can be avoided. Thus, the reliability of the joining structure of the outer shell can be improved, and no undesirable thermal stress is produced between the extension and the inner pipe. In particular, by allowing relative movement between the outer shell and the rear end of the inner pipe, development of thermal stress therebetween can be avoided.

Although the present invention has been described in terms of specific embodiments, it is possible to modify and alter details thereof without departing from the spirit of the present invention.

What we claim is:

1. An exhaust muffler comprising:

an outer shell consisting of two halves made of synthetic resin material abutting each other at a brim portion of each of said two halves, each of said two halves being provided with a hollow semi-cylindrical extension extending from said brim portion of the corresponding half so as to form a completely tubular extension by the cooperation of said two hollow semi-cylindrical extensions;

an inner pipe made of metallic material extending through said outer shell and out of said tubular extension of said outer shell;

a sleeve member fitted onto said tubular extension at one end thereof and fitted in a substantially airtight fashion onto a part of said inner pipe extending out of said tubular extension of said outer shell t the other end thereof; and fastening means for securing said sleeve member fitted on said tubular extension and producing a radial securing force which urges said semi-cylindrical extensions toward each other, wherein said tubular extension of said outer shell is provided with an annular radial projection having at least one notch, and said one end of said sleeve member is provided with a radially inwardly directed projection which is adapted to be axially passed through said notch when said sleeve member is fitted onto said tubular extension so that said sleeve member may be secured on said tubular extension by turning said sleeve member around an axial line thereof after said sleeve member is fitted onto said tubular extension until said radially inwardly directed projection is passed through said notch beyond said annular radial projection.

2. An exhaust muffler according to claim 1, wherein said sleeve member is made of metallic material.

3. An exhaust muffler according to claim 1, wherein said outer shell is internally lined with a layer of insulating material, and an extension of said insulating material layer extends into an annular space between said sleeve member and said inner pipe.

4. An exhaust muffler according to claim 1, wherein a side surface of said annular radial projection facing away from said outer shell is formed as a tapered annular surface.

5. An exhaust muffler according to claim 1, wherein a rear end of said sleeve member is closely but slidably fitted onto said inner pipe.

6. An exhaust muffler according to claim 1, wherein said other end of said sleeve member is folded back inwardly so as to be closely and elastically fitted onto said inner pipe.

7. An exhaust muffler according to claim 1, wherein an annular member having a low friction coefficient and a heat resisting property is interposed between said other end of said tubular member and said inner pipe.

8. An exhaust muffler comprising:

an outer shell consisting of two halves made of synthetic resin material abutting each other at a brim portion of each of said two halves, each of said two halves being provided with a hollow semi-cylindrical extension extending from said brim portion of the corresponding half so as to form a completely tubular extension by the cooperation of said two hollow semi-cylindrical extensions;

an inner pipe made of metallic material extending through said outer shell and out of said tubular extension of said outer shell;

a sleeve member fitted onto said tubular extension at one end thereof and fitted in a substantially airtight fashion onto a part of said inner pipe extending out of said tubular extension of said outer shell at the other end thereof; and fastening means for securing said sleeve member fitted on said tubular extension and producing a radial securing force which urges said semi-cylindrical extensions toward each other, wherein said other end of said sleeve member is securely welded to the inner pipe, and is provided with means for accommodating relative movement between the outer shell and the inner pipe.

9. An exhaust muffler comprising:

an outer shell consisting of two halves made of synthetic resin material abutting each other at a brim portion of each of said two halves, each of said two halves being provided with a hollow semi-cylindrical extension extending from said brim portion of the corresponding half so as to form a completely tubular extension by the cooperation of said two hollow semi-cylindrical extensions;

an inner pipe made of metallic material extending through said outer shell and out of said tubular extension of said outer shell;

a sleeve member fitted onto said tubular extension at one end thereof and fitted in a substantially airtight fashion onto a part of said inner pipe extending out of said tubular extension of said outer shell at the other end thereof; and fastening means for securing said sleeve member fitted on said tubular extension and producing a radial securing force which urges said semi-cylindrical extensions toward each other, wherein said other end of said sleeve member is securely welded to the inner pipe, and a part of the inner pipe is provided with means for accommodating relative movement between the outer shell and the inner pipe.

10. An exhaust muffler according to claim 8, wherein said means for accommodating relative movement comprises a corrugated sleeve member.

11. An exhaust muffler according to claim 9, wherein said means for accommodating relative movement comprises a corrugated inner pipe.

* * * * *